United States Patent [19]

Baynes

[11] Patent Number: 4,810,012

[45] Date of Patent: Mar. 7, 1989

[54] CLOSURE LATCH

[75] Inventor: Dennis Baynes, Longford, England

[73] Assignee: General Motors Corporation, Detroit, Mich.

[21] Appl. No.: 87,043

[22] Filed: Aug. 19, 1987

[51] Int. Cl.[4] ..... E05C 3/34

[52] U.S. Cl. ..... 292/28; 292/DIG. 25

[58] Field of Search ..... 242/28, 50, 304, DIG. 14, 242/DIG. 39, DIG. 25, 30, 53

[56] References Cited

U.S. PATENT DOCUMENTS

| | | | |
|---|---|---|---|
| 197,115 | 11/1877 | Frees | 292/28 |
| 1,215,992 | 2/1917 | Rein . | |
| 1,542,151 | 6/1925 | LOehtonen . | |
| 3,336,075 | 8/1967 | Wilson | 292/146 |
| 3,601,434 | 8/1971 | Fargo | 292/50 X |
| 3,630,557 | 12/1971 | Pierce | 292/DIG. 14 X |
| 4,061,371 | 12/1977 | Prather et al. | 292/198 |

*Primary Examiner*—Richard E. Moore

*Attorney, Agent, or Firm*—Herbert Furman

[57] ABSTRACT

A vehicle closure latch includes a housing member provided with a slot opening to opposite sides thereof. A pair of latch bolt members are pivoted to the housing member within the slot in scissors fashion for movement inwardly and outwardly of the slot between latched and unlatched positions.

3 Claims, 2 Drawing Sheets

CLOSURE LATCH

This invention relates generally to closure latches and more particularly to vehicle closure latches for releasably latching vehicle closures in closed position.

Conventional vehicle closure latches include rotary type members such as fork bolts or gear type members which rotate within a latch housing into and out of engagement with a striker member. The vehicle closure latch of this invention differs from such known vehicle closure latches in that it includes a pair of bolt members which are arranged in scissors fashion within a housing for movement outwardly of the housing to a latched position and movement inwardly within the housing to an unlatched position.

In the preferred embodiment of the invention, a housing includes an elongated slot, the sides of which open outwardly of the housing. A pair of latch bolt members are housed within the slot in scissors fashion relative to each other. Each latch bolt member includes a hook shaped latching portion at one end thereof, an intermediate apertured portion, and an operating portion at the other end thereof. The hook shaped latching portion of one bolt member and the operating portion of the other bolt member move relative to one open side of the slot, while the hooked shaped latching portion of the other bolt member and the operating portion of the one bolt member move relative to the other open side of the slot. A pin traverses the slot and the intermediate apertured portions of the bolt members to rotatably mount the bolt members within the housing. Resilient means on the pin bias the bolt members oppositely of each other to bias the latching portions and operating portions oppositely of each other and outwardly of the open sides of the slot. Operating means, such as a cable interconnects the operating portions to move them toward each other and within the housing to retract the latching portions within the slot and move the bolt members to unlatched position.

The striker member includes two successive sets of spaced shoulders. Upon entry of the housing into the striker member, the hook shaped latching portions of the bolt members engage the first set of shoulders and are cammed inwardly of the housing to unlatched position. When the latching portions pass the first set of shoulders, the resilient means moves the latching portions of the bolt members into engagement with the first set of shoulders to locate the closure in an intermediate closed position. Upon further entry of the housing into the striker, the latching portions engage the second set of shoulders and are again cammed inwardly of the housing to unlatched position. When the latching portions pass the second set of shoulders, the resilient means moves the latching portions to latched position in engagement with the second set of shoulders to hold the closure in fully closed position. Operation of the operating means in the intermediate or fully closed positions of the closure moves the bolt members to unlatched position to permit withdrawal of the housing as the closure moves to open position.

The primary feature of this invention is that it provides an improved vehicle closure latch which includes a pair of latch bolt members arranged in scissors fashion relative to each other for movement outwardly and inwardly of the open sides of a housing between respective latched and unlatched positions. Another feature is that the latch bolt members are provided with hook shaped latching portions which are releasably engageable with successive sets of shoulders of a striker member to hold the closure member in successive closed positions. A further feature is that the hook shaped latching portions are cammingly engageable with the sets of shoulders of the striker member so as to move through and behind the shoulders and into engagement therewith. Yet another feature is that pivot means coaxially pivots intermediate portions of the latch bolt members to each other, and a resilient means biasing the latch bolt members to latched position is mounted on the pivot means. Yet a further feature is that the latch bolt members are moved to their unlatched position within the housing and against the bias of the resilient means by operating means which interconnect operating portions of the latch bolt members.

These and other features will be readily apparent from the following specification and drawings wherein.

Figure 1:
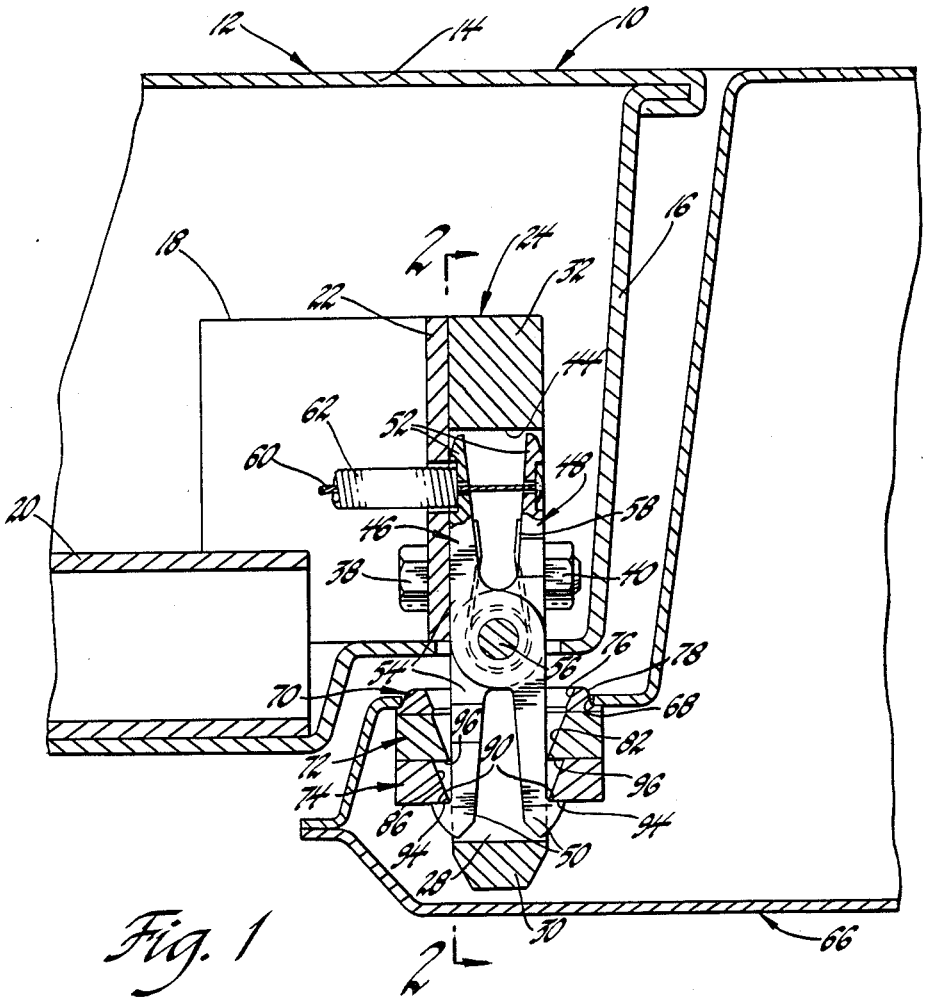
FIG. 1 is a sectional view of a portion of a vehicle body having a vehicle closure held in closed position relative to a vehicle pillar by a closure latch according to this invention.

Referring now to FIG. 1, a vehicle designated generally 10 includes a front door or closure 12 having an outer panel 14 and an inner panel 16 which are hem flanged to each other in conventional fashion. An angle bracket 18 is mounted in a suitable manner to the inner panel 16 and a cross beam 20 and includes a vertical flange 22.

A latch housing designated 24 is of elongated construction and includes an upper wall 26, a lower wall 28, a forward or leading frustoconical end 30 and a rearward or trailing rectangular end 32. Formed integrally with the upper and lower walls 26 and 28 are ears 34 provided with elongated apertures 36. Bolts 38 extend through apertures of flange 22 of bracket 18 and through ears 34 into nuts 40 to mount the housing 24 on door 12. The inner wall of the inner panel 16 is apertured at 42 to permit the housing 24 to project outwardly of the inner wall of panel 16 of door 12.

Figure 2:
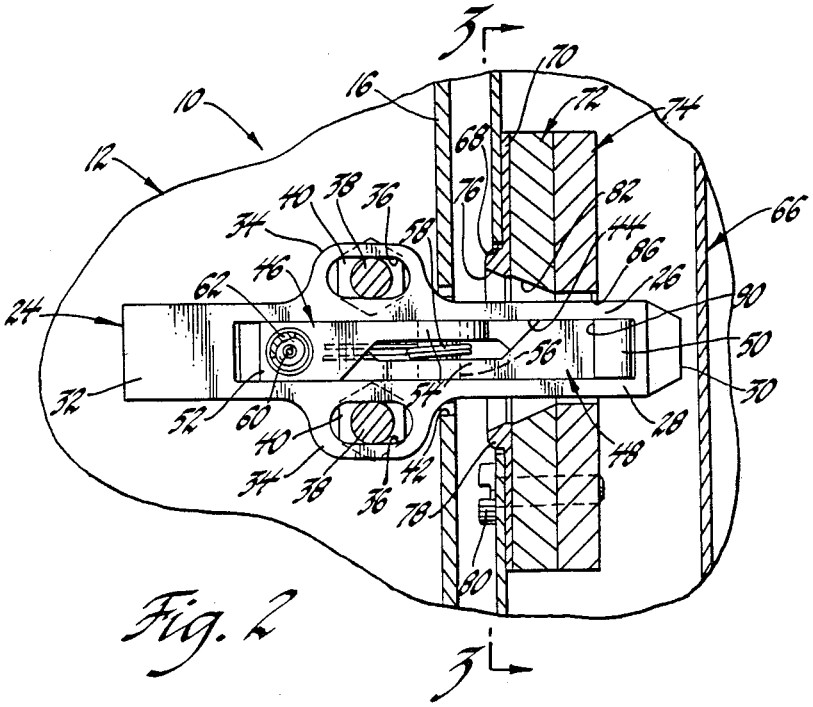
FIG. 2 is a view taken generally along line 2—2 of FIG. 1.
Figure 3:
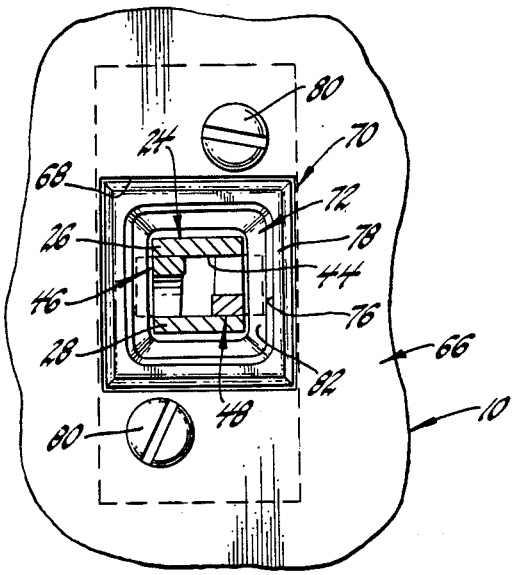
FIG. 3 is a sectional view taken generally along line 3—3 of FIG. 2.

The upper and lower walls 26 and 28, the forward end 30, and the rearward end 32 of housing 24 cooperatively define a slot 44 which opens outwardly to each side of the housing 24. A pair of like latch bolt members 46 and 48 are housed within the slot 44 in scissors fashion. Each of the members includes a hook shaped latching portion 50, an apertured operating portion 52, and an intermediate portion 54. Intermediate portions 54 are apertured and of reduced thickness as can be seen in FIG. 2 so as to overlie each other and permit the members 46 and 48 to be arranged in scissors fashion within the slot 44 of the housing 24. A pivot pin 56 extends through the upper and lower walls 26 and 28 of the housing 24 and the apertured intermediate portions 54 of the latch bolt members 46 and 48 to mount the latch bolt members within the slot 44 for movement between latched and unlatched positions as will be further described. A coil torsion spring 58 surrounds the pin 56 and biases the latch bolt members oppositely of each other to bias the latching portions 50 and the operating portions 52 outwardly of the open sides of the slot 44.

An operating cable 60 extends through a fixed sheath 62 and recessed apertures in the operating portions 52 of both of the latch bolt members 46 and 48. The end of the cable is secured to the operating portion 52 of latch bolt member 48 within the recess thereof. Since the sheath 62 is fixed, any movement of the cable 60 to the left, as viewed in FIG. 1 or in FIG. 4, will move the operating portions 52 toward each other and within the slot 44 from their FIG. 1 position to their FIG. 4 position. This in turn moves the latching portions 50 also within the slot 44 from their FIG. 1 latched position to their FIG. 4 unlatched position. The cable 60 and sheath 62 are normally located relative to each other, as shown in FIG. 1, to permit the latching portions 50 to be located in latched position as shown therein under the bias of the spring 58.

A vehicle body pillar 66 includes a generally square shaped opening 68. A striker assembly includes a cover member 70 and a pair of striker plates 72 and 74, all of vertically elongated rectangular configuration. The cover plate 70 fits against the inside surface of pillar 66 and includes an opening 76 surrounded by a raised rib formation 78 which fits within the openings 68 of the pillar 66. The striker plates 72 and 74 are riveted or otherwise secured to each other. Bolts 80 extend through pillar 66, cover plate 70 and into tapped openings of plates 72 and 74 to mount the cover plate and the striker plates to pillar 66. The striker plate 72 includes an inwardly tapered opening 82, the inner end of which is slightly greater in size than the exterior configuration of the housing 24. The striker plate 74 includes an opening having tapered side walls 86 and planar upper and lower walls 88. The inner end of opening 84 is of the same size as the inner end of opening 82 and is aligned therewith.

Figure 4:
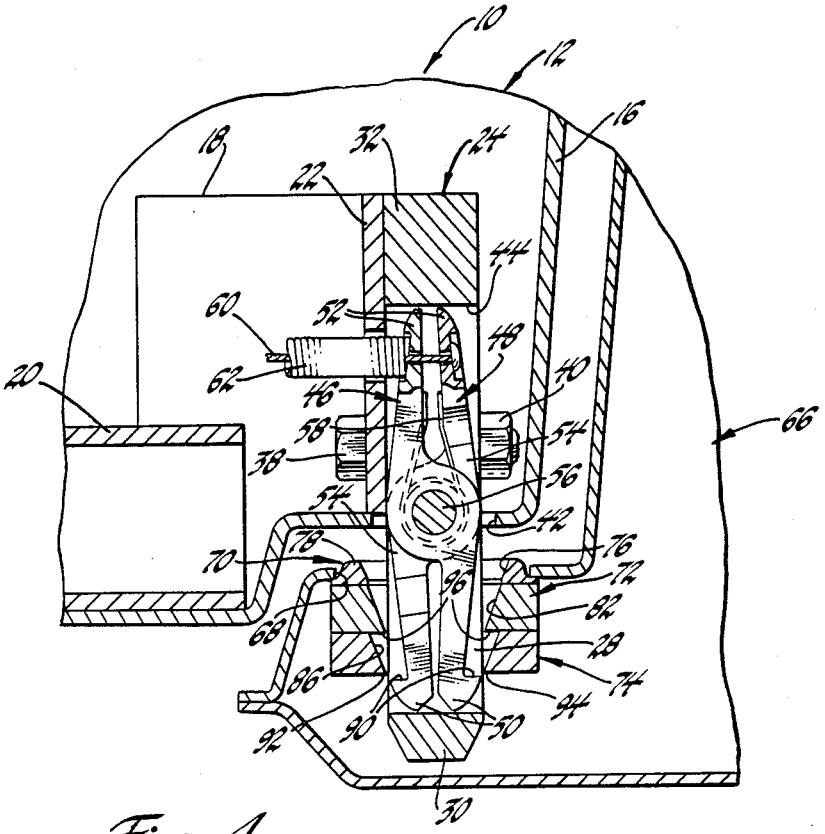
FIG. 4 is a view similar to FIG. 1 and showing the latch bolt members in unlatched position.

When the vehicle door 12 is in closed position, as shown in FIG. 2, and it is desired to release the door for movement to open position, the cable 60 is pulled or shifted to the left as viewed in FIG. 1 to move the operating portions 52 of the latch bolt members 46 and 48 toward each other to their position shown in FIG. 4. This moves the latch bolt members 46 and 48 to unlatched position within slots 44 as the latching shoulders 90 of latching portions 50 disengage from shoulders 92 of striker plate 74. Thereafter, the door 12 can be moved to open position as the housing 24 withdraws from the openings 82 and 84 of the striker plates 72 and 74 and opening 76 of cover plate 70. Once the housing 24 has been withdrawn from opening 76, the cable 60 is released and the spring 58 returns the latch bolt members 46 and 48 to their latched position, as shown in FIG. 1, but released from striker plate 74.

Upon closing movement of door 12, the engagement of the arcuate leading shoulders 94 of the latching portions 50 with the tapered opening 82 of striker plate 72 will cam the latch bolt members 46 and 48 inwardly of slot 44 to their unlatched position until the shoulders 94 have moved inwardly through the opening 82. Thereupon, the spring 58 will return the latch bolt members 46 and 48 to their latched position with shoulders 90 engaging latching shoulders 96 of striker plate 72. This will hold the door 12 in a partially closed or intermediate latched position. If the door 12 is moved to a fully closed position, the engagement of the leading shoulders 94 of latching portions 50 with the tapered side walls 86 will again cam the latch bolt members 46 and 48 inwardly of slot 44 to unlatched position until the shoulders 94 have moved past walls 86. Thereupon the spring 58 will return the latch bolt members to their latched position as the shoulders 90 engage shoulders 92 of striker plate 74 to maintain the door 12 in fully closed position.

Thus, this invention provides an improved vehicle closure latch.

The embodiments of the invention in which an exclusive property or privilege is claimed are defined as follows:

1. A vehicle closure latch for releasably latching a vehicle closure member to a vehicle pillar member, comprising, in combination, an elongated latch housing member mounted on one of the vehicle members and including a slot provided with a pair of open sides opening outwardly of the housing member, a pair of latch bolt members located within the slot, each bolt member including a latching end portion and an operating end portion, the latching end portion of one bolt member being located adjacent one side opening of the slot and the latching end portion of the other bolt member being located adjacent the other side opening of the slot, the operating end portion of the one bolt member being located adjacent the other side opening of the slot and the operating end portion of the other bolt member being located adjacent the one side opening of the slot, pivot means rotatably mounting the bolt members within the slot for movement between an unlatched position wherein the latching end portions of the bolt members are located within the side openings of the slot and a latched position wherein the latching end portions of the bolt members extend outwardly of the side openings of the slot, resilient means biasing the latch bolt members to latched position, means connected to the operating end portions of the latch bolt members to move the latch bolt members to unlatched position, and striker means mounted on the other of the vehicle members and including shoulder means engageable by the latching end portions of the latch bolt members in latched position to maintain the vehicle closure member in closed position relative to the vehicle pillar member.

2. A vehicle closure latch for releasably latching a vehicle closure member to a vehicle pillar member, comprising, in combination, an elongated latch housing member mounted on one of the vehicle members and including an elongated slot provided with a pair of open sides opening outwardly of the housing member, a pair of latch bolt members located within the slot, each bolt member including a hook shaped latching end portion and an operating end portion, the latching end portion of one bolt member being located adjacent one side opening of the slot and the latching end portion of the other bolt member being located adjacent the other side opening of the slot, the operating end portion of the one bolt member being located adjacent the other side opening of the slot and the operating end portion of the other bolt member being located adjacent the one side opening of the slot means rotatably mounting the bolt members within the slot for movement between an unlatched position wherein the latching end portions of the bolt members are located within the slot adjacent the side openings of the slot thereof and a latched position wherein the latching end portions of the bolt members extend outwardly of the side openings of the slot, resilient means biasing the latch bolt members to latched position, means interconnecting the operating end portions of the latch bolt members to move the latch bolt members to unlatched position, and striker means mounted on the other of the vehicle members and including an aperture for receiving the latch bolt housing therethrough and shoulder means to each side of the aperture for engagement by hook shaped latching end portions of the latch bolt members to block withdrawal movement of the latch bolt housing relative to the striker means and maintain the vehicle closure member in closed position relative to the vehicle pillar member.

3. A vehicle closure latch for releasably latching a vehicle closure member to a vehicle pillar member, comprising, in combination, an elongated latch housing member mounted on one of the vehicle members and including an elongated slot provided with a pair of open sides opening outwardly of the housing member, a pair of elongated latch bolt members, each including a hook shaped latching end portion, an operating end portion, and an intermediate apertured portion, the latch bolt members being located within the slot in a scissors type arrangement with the latching end portion of one bolt member being located adjacent one side opening of the slot and the latching end portion of the other bolt member being located adjacent the other side opening thereof, the operating end portion of the one bolt member being located adjacent the other side opening of the slot and the operating end portion of the other bolt member being located adjacent the one side opening thereof, the intermediate apertured portions being located in overlying relationship, pivot means extending through the intermediate portions of the bolt members to mount the bolt members on the housing member for movement between an unlatched position wherein the latching end portions of the bolt members are located within the slot adjacent the side openings thereof and a latched position wherein the latching end portions of the bolt members extend outwardly of the side openings of the slot, resilient means on the pivot means biasing the latch bolt members oppositely of each other about the pivot means to latched position, means interconnecting the operating end portions of the operating end portions toward each other and move the latch bolt members to unlatched position, and striker means mounted on the other of the vehicle members and including an aperture for receiving the latch bolt housing and shoulder means to each side of the aperture for engagement by the latching end portions of the latch bolt members to block withdrawal movement of the latch bolt housing relative to the striker means and maintain the vehicle closure member in closed position relative to the vehicle pillar member.

* * * * *